United States Patent [19]

Chiavetta et al.

[11] Patent Number: 4,874,163

[45] Date of Patent: Oct. 17, 1989

[54] ROCKING TOY

[75] Inventors: Sebastiano R. Chiavetta; Giorgio De Guglielmi, both of Schio, Italy

[73] Assignees: Applause, Inc., Woodland Hills, Calif.; Jockline, S R L., Italy

[21] Appl. No.: 104,642

[22] Filed: Oct. 2, 1987

[30] Foreign Application Priority Data

Jun. 19, 1987 [IT] Italy ..... 48078 A/87

[51] Int. Cl.[4] ..... A63G 17/00

[52] U.S. Cl. ..... 272/53.2; 272/52

[58] Field of Search ..... 272/52, 52.5, 53.1, 272/53.2

[56] References Cited

U.S. PATENT DOCUMENTS

| | | | |
|---|---|---|---|
| 31,571 | 2/1861 | Crandall | 272/52 |
| 31,869 | 4/1861 | Christian | 272/52 |
| 33,552 | 10/1861 | Vincent et al. | 272/52 |
| 42,960 | 5/1864 | Northryn | 272/52 |
| 2,478,091 | 8/1949 | Dwyer | 272/53.2 |
| 2,544,106 | 3/1951 | Ray . | |
| 2,668,579 | 2/1954 | Swengel . | |
| 2,756,051 | 7/1956 | Shone . | |
| 2,814,490 | 11/1957 | Connet, Sr. | 272/52 |
| 2,825,563 | 3/1958 | Lawton . | |
| 2,968,483 | 1/1961 | Dodson . | |
| 3,013,764 | 12/1961 | Kuhn . | |
| 3,138,376 | 6/1964 | Ryan . | |
| 3,180,640 | 4/1965 | Lawrence . | |
| 3,406,934 | 10/1968 | Grudoski . | |
| 3,904,196 | 9/1975 | Berlin . | |
| 4,681,314 | 7/1987 | Swengel, Sr. | 272/52 |
| 4,690,397 | 9/1987 | Abed | 272/53.2 |

FOREIGN PATENT DOCUMENTS

| | | | |
|---|---|---|---|
| 937608 | 8/1948 | France | 272/53.2 |
| 149 | of 1861 | United Kingdom | 272/52 |

*Primary Examiner*—David A. Scherbel
*Assistant Examiner*—Richard E. Chilcot, Jr.
*Attorney, Agent, or Firm*—Spensley Horn Jubas & Lubitz

[57] ABSTRACT

A rocking toy has an animal-shaped body supported by a tubular framework. The framework has a fore and a hind frame portion. The hind frame is rightly supported on a base. A resilient member is placed between the fore and the hind portion, allowing a limited movement that simulates a horse rearing on its hind legs.

7 Claims, 1 Drawing Sheet

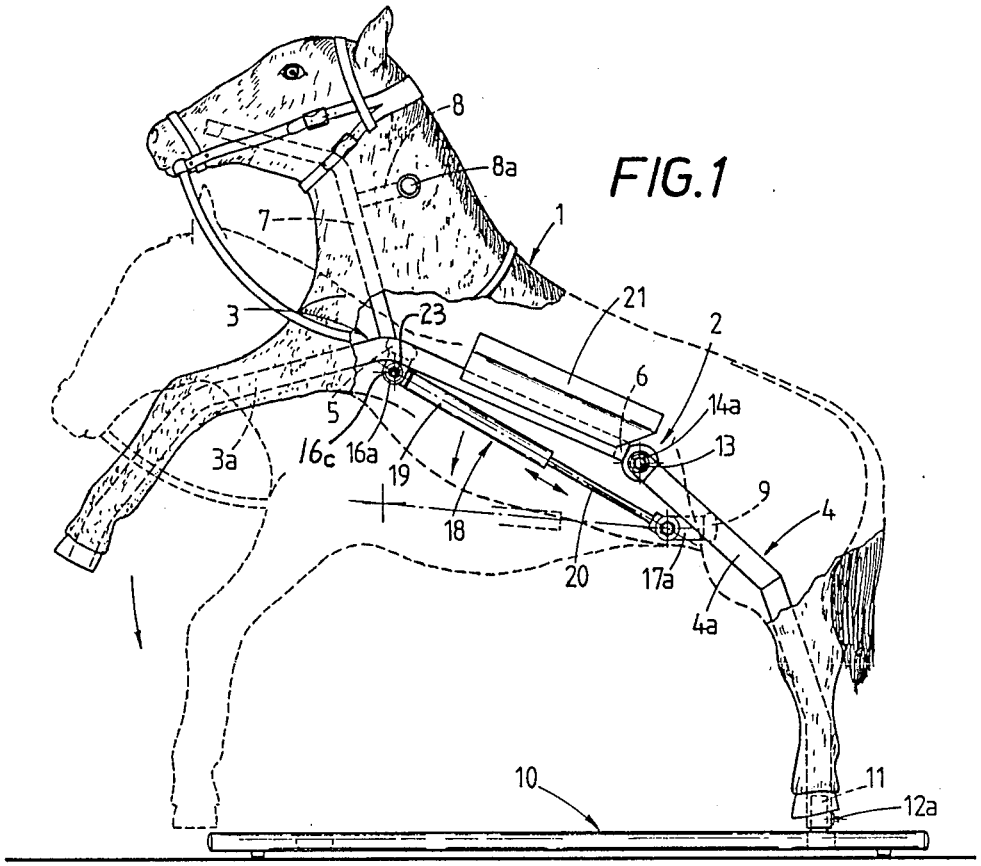
FIG. 1
FIG. 2
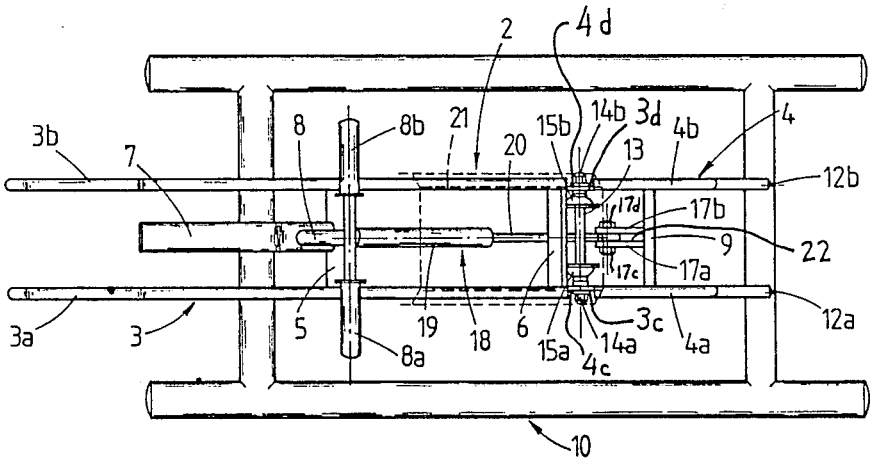

ROCKING TOY

BACKGROUND OF THE INVENTION

1. Field of the Invention

This invention relates to toys for children and more specifically to rocking toys such as rocking horses.

2. Description of the Related Art

In one type of rocking horses, a seat is supported by a convex shaped base in contact with the floor. Forward and back motion of a child's body simulating a ride on horseback causes the convex base (and hence the seat) to rock about an axis of rotation passing through points of contact betweeen the convex base and the floor.

In another familiar implementation, the rocking horse is mounted on a stationary base in a manner which allows the horse to rock about a horizontal axis of rotation centrally located within the rocking horse at a certain height from the floor. The rocking motion is initiated by the shifting of the weight of the child.

For example, U.S. Pat. No. 3,138,376 to Ryan relates to a rocking horse with an elevated axis of rotation. The horse's body is supported by an integral upright and a yoke extending upwardly from the upright. A transverse pin forms an axis of rotation about which the horse rotates. A link has a horizontal pivot mounting at one end at a selected elevation on the upright.

Another design described in U.S. Pat. No. 2,968,483 to Dodson relates to a rocking horse with a rocker arm and a seat member. A rear spring reciprocates the motion of the rocker arm with respect to the seat member. A front spring reciprocates the motion between the rocker arm and a floor support.

The motions provided by these prior designs have not been very realistic. It is an object of this invention to provide a more satisfying toy by allowing the child to ride the horse "lone ranger" style with the horse rearing on its hind legs. It is a further object to provide a toy which can move more realistically, simulating the movement of a horse in gallop or in a steeple chase.

SUMMARY OF THE INVENTION

In the illustrated embodiment, the rocking toy of this invention has a padded animal-shaped body supported by a framework. The framework has two articulated sections, a hind frame section and a fore frame section, that can move with respect to each other in a limited fashion. A resilient member, such as a gas-filled cylinder with a piston therein, is placed with one end on the fore frame and the other end on the hind frame. The cylinder stores the energy of a downward motion of the fore frame by compression. The energy is then released to aid the upward motion of the fore frame.

In another aspect of the invention, the hind frame which is secured at one end of a support base forms part of the rear legs of the animal while the front frame forms a part of the front legs.

The invention will be more clearly understood from the following description of a preferred embodiment with reference to the accompanying drawings.

BRIEF DESCRIPTION OF THE DRAWINGS

FIG. 1 is a partially sectioned side elevational view of a rocking toy in accordance with one embodiment of the present invention, which is shown in an upward position in full lines and in a downward position in dashed lines; and FIG. 2 is a top view of the support frame and base of the toy of FIG. 1.

DESCRIPTION OF THE PREFERRED EMBODIMENT

The following description is of the best presently contemplated mode of carrying out this invention. This description is made for the purpose of illustrating the general principles of the invention and should not be taken in a limiting sense. The scope of the invention is best determined by reference to the appended claims.

Referring to FIG. 1, a rocking toy in accordance with a preferred embodiment of the present invention is indicated generally at 1. The exterior body of the rocking toy 1 can be manufactured of a flexible resilient material in a padded shaggy animal shape, such as a horse as shown. It is recognized that other shapes, including those of other animals, may be used.

An inner framework 2 of the rocking toy 1 includes a fore frame portion 3 (see also FIG. 2) and a hind frame portion 4 which are formed of tubular parallel side members 3*a* and 3*b*, 4*a* and 4*b*, respectively. The fore side members 3*a* and 3*b* and the hind side members 4*a* and 4*b* are bent to fit and support the horse's exterior body, especially at the legs. As will be described in greater detail below, the fore and hind frame portions 3 and 4 pivotally and resiliently coupled together in a manner which permits a rearing-type rocking motion.

The fore side members 3*a* and 3*b* are connected to each other by two cross members 5 and 6. Cross member 5 is joined to a head support frame portion 7 which bends upwards, toward the head of the horse. The frame portion 7 is further joined to a T-shaped tubular member 8, on which handles 8*a*, 8*b* are mounted for a child to hold on.

The hind side members 4*a* and 4*b* are connected to each other by a cross member 9. The side members 4*a* and 4*b* are attached to a support base 10 by upright shanks 11*a* and 11*b*, integral with the base 10. The shanks 11*a* and 11*b* are inserted into the hind side members 4*a* and 4*b* and are locked in place by locking bolts 12*a* and 12*b*. The support base 10 is illustrated as a rectangular frame but may have other shapes as well.

The fore portion 3 is pivotally connected to the hind portion 4 of the framework 2 by a pin 13 passing through coaxial holes formed into connecting plates 3*c* and 3*d* integral with the back ends of the side members 3*a* and 3*b*, respectively, and connecting plates 4*c* and 4*d* integral with the fore ends of the side members 4*a* and 4*b*, respectively. The pin 13 is provided with threaded ends. The pin 13 connecting the plates 3*c* and 4*c* of the side members 3*a* and 4*a* and the plates 3*d* and 4*d* of the side members 3*b* and 4*b* is secured in place by spacers abutting members 15*a* and 15*b* and nuts 14*a* and 14*b* screwed at the threaded ends of pin 13. In this manner the fore portion 3 of framework 2 can pivot up and down with respect to the hind portion 4.

Bored connection plates 17*a* and 17*b* extend side-by-side from the hind cross member 9. Another pair of connection plates 16*a* and 16*b* are directed essentially downwards and are attached side-by-side to the cross member 5 of the fore portion 3 of the framework 2. A so-called "gas pump" type resilient device 18 is pivotally connected at opposite ends to said connection plates 16*a*, 16*b*, 17*a* and 17*b* by means of threaded bolts and nuts 16*c*, 16*d*, 17*c* and 17*d*, respectively. Such "pump" device 18 includes a pneumatic cylinder 19 in which a piston is sealingly received. A high pressure gas is contained within the cylinder 19 so that the inner surface of the piston is subjected to the pressure of the gas and the outer surface thereof is at atmospheric pressure. A free bored end 22 of a piston rod 20 is pivotally connected to the connection plates 17*a* and 17*b* of the hind portion 4 of the framework 2 by means of the above-mentioned bolt and nut 17*c* and 17*d*. The opposite end of the cylinder 19 is also pivotally connected to the connection plates 16*a* and 16*b* integral with the cross member 5 of the fore portion 3 of the framework 2 by means of bolt and nut 16*c* and 16*d* engaging a pivot pin 23.

The operation of the assembly would not change substantially if the position of the gas pump was to be reversed.

The gas pump device 18 varies in length as pressure is applied, allowing the fore portion 3 of the framework 2 to rotate downward as a load is applied thereon, i.e. when a child sits on the back and moves his body forward. The gas pump 18 operates as a spring resisting the lowering of the fore portion of the rocking horse. As the fore portion lowers, energy is stored in the gas pump device 18, until the latter reaches maximum compression at which point the pump device resisting force equals the downward force, preventing further lowering of the fore portion. Energy is then released as the child moves his body back and the fore portion of the rocking horse stands up again. A bent plate 21 is provided for protecting the gas pump mechanism. Of course, the padding and the shaggy horse-shaped covering are flexible, thus conforming to the motion of the fore portion of the rocking horse.

While the invention has been described with respect to a preferred embodiment, it will be apparent to one skilled in the art that other modifications can be made without departing from the spirit or scope of the present invention as defined and claimed herein.

We claim:

1. A rocking toy comprising:

a base;

a support frame carried by said base, said frame having a hind section and a fore section pivotally coupled to the hind section;

an external, flexible, animal-shaped body supported by the support frame;

means for rigidly supporting the hind section on the base; and resilient means coupling the hind section to the fore section for compressively storing the energy of a downward movement of the fore section, and assisting an upward movement of the fore section by releasing said energy.

2. A rocking horse having a head, and fore and hind legs comprising:

a. a generally rectangular base;

b. an elongated hind frame having an upper end and a lower end; said elongated hind frame being secured to the base at said lower end in an upstanding position and forming a portion of the hind legs of the horse;

c. an elongated fore frame pivotally coupled to the upper end of the hind frame so that the fore frame can pivot up and down with respect to the hind frame; said fore frame forming a portion of the fore legs of the horse;

d. resilient means coupling the fore frame to the hind frame for storing energy as the fore frame is pivoted downward and for releasing energy as the fore frame is pivoted upward so as to assist the movement of said fore frame; and e. a head support frame carried by the fore frame for forming a portion of the head of the horse.

3. The rocking horse of claim 2 wherein the fore and hind frames each comprise a pair of tubular members and a transverse member joining the tubular members.

4. The rocking horse of claim 2 or claim 3 wherein the head support frame has a graspable transverse handle for the horse.

5. The rocking horse of claim 2 wherein the resilient means comprises a gas filled cylinder and a movable piston within the cylinder.

6. The rocking horse of claim 5 wherein the cylinder is coupled at one end to one of the fore and hind frames and the piston has a pivot pin coupled to the other frame.

7. A rocking animal toy having a head, and front and hind legs comprising:

a generally rectangular base;

a generally upward hind frame having an upper end and a lower end and further comprising two parallel tubular members connected by a first cross member, said lower end of said hind frame being secured to one end of the rectangular base so as to form a portion of the hind legs of the animal;

a generally forward fore frame also comprising two parallel tubular members connected by a second cross member, said fore frame being pivotally coupled to the upper end of the hind frame and forming a portion of the fore legs of the animal;

an axial pin connecting the front and the hind frame;

a resilient-member comprising a gas-filled cylinder and a movable piston within the cylinder, said resilient member having a cylinder end and a piston end; said piston end being coupled to the first cross member and said cylinder end being coupled to the second cross member so as to compressively store the energy of a downward movement of the fore frame and assist in the upward movement of said fore frame by releasing said energy;

an upward head frame connected to the second cross member and having a graspable transverse handle;

a flexible animal shaped body supported by the fore, hind and head frames.

* * * * *